US005471710A

United States Patent [19]

Demuth et al.

[11] Patent Number: 5,471,710

[45] Date of Patent: Dec. 5, 1995

[54] APPARATUS FOR ATTACHING WORKING ELEMENTS

[75] Inventors: Robert Demuth, Nurendorf; Beat Naef, Jona; Werner Hirschle; Lars Weisigk, both of Winterthur, all of Switzerland

[73] Assignee: Maschinenfabrik Rieter AG, Winterthur, Switzerland

[21] Appl. No.: 219,383

[22] Filed: Mar. 29, 1994

[30] Foreign Application Priority Data

Mar. 30, 1993 [CH] Switzerland ..... 00979/93

[51] Int. Cl.[6] ..... D01G 15/28

[52] U.S. Cl. ..... 19/113; 19/98; 19/114

[58] Field of Search ..... 19/104, 113, 98

[56] References Cited

FOREIGN PATENT DOCUMENTS

| | | |
|---|---|---|
| 0252018 | 1/1988 | European Pat. Off. . |
| 0476407 | 3/1992 | European Pat. Off. . |
| 652484 | 3/1929 | France . |
| 609287 | 1/1935 | Germany . |
| 358722 | 1/1962 | Switzerland . |
| 1582405 | 1/1981 | United Kingdom . |

*Primary Examiner*—John J. Calvert

*Attorney, Agent, or Firm*—Sandler Greenblum & Bernstein

[57] ABSTRACT

An apparatus for attaching working elements, such as carding elements, to a rotating fiber-opening roller, such as a licker-in, wherein the working element is attached on the axle boxes or retainers of the roller by means of an end cap at least partially encompassing the axle boxes or axle retainers.

20 Claims, 3 Drawing Sheets

APPARATUS FOR ATTACHING WORKING ELEMENTS

CROSS REFERENCE TO RELATED APPLICATIONS

This application claims the priority of Swiss Application No. 00 979/93-4, filed Mar. 30, 1994, the disclosure of which is incorporated herein by reference in its entirety.

BACKGROUND OF THE INVENTION

1. Field of the Invention

This invention pertains to an apparatus for attaching working elements, in particular a fixed carding element to a rotating, fibre-opening roller of a preparatory machine in a spinning mill.

2. Discussion of the Background of the Invention and Material Information

It is known, in spinning mill preparatory machines, particularly in carding machines, to attach working elements, such as separation knives, fixed carding elements, and the like, directly on the machine frame and that they are then set to the correct radial and/or pivot distance, relative to the rotating roller, by means of setting means such as eccentrically held discs, slots, spacers, or the like.

These settings require a considerable amount of effort and have to be carried out regularly in several partial steps, as the adjustment of the setting means and a subsequent fixation, via a screw, again causes a slight displacement of the setting, i.e. the distance, to be made. For such settings it is necessary to precisely adhere to the required tolerance ranges, which are constantly becoming increasingly narrower, by means of sheet calibers, screw pitch gages and the like.

Therefore, it an the object of this invention to achieve similarly precise distances, within a narrow tolerance range, in a more simple manner than in the previously-described methods.

SUMMARY OF THE INVENTION

This object is achieved via an apparatus for attaching a working element to a rotating fiber-opening roller, the roller being rotatably journalled in spaced axle retainers, wherein the working element is attached on the axle retainers via respective end caps, with the end caps at least partially encompassing the axle retainers.

The end caps are connected either to the axle retainers or with the working element, with each of the end caps preferably being provided with a plane surface in the zone of the working elements or the axle retainers.

In one embodiment of the present invention, each of the end caps is at least partially prismatically formed.

In another embodiment of the present invention, each of the end caps is provided with a recess, with the recess including means for guiding, which preferably consists of angular grooves.

In a further embodiment of this invention, each of the end caps is of unitary or one piece construction either with the axle retainer or the working element.

Previously, it was always the custom that fiber-opening rollers were held directly in a machine frame and that the pertinent working elements, such as separation knives and fixedly arranged carding elements, were also attached to the machine frame. Owing to the production tolerances it was thus necessary to set the required working distances by means of setting means such as spacers, slots, screws, etc. only during the installations thereof. However, since the production of fiber-opening rollers, such as pin rollers, clothing rollers provided with saw teeth, or needle rollers, with ever increasing precision, the outer circumferences become nearly ideally cylindrical and the diametral tolerances are kept minimal.

This trend or realization caused us to seek new means to allow the working elements to be arranged more precisely with respect to the roller. An accurately fitting attachment of the working element on the axle box or bearing retainer of the rotating roller gives, in addition to the advantage that less components are required, among other things, the added enormous advantage that a textile machine can be produced with less effort related to work the involved, i.e., with considerably less adjustment work.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Figure 1:
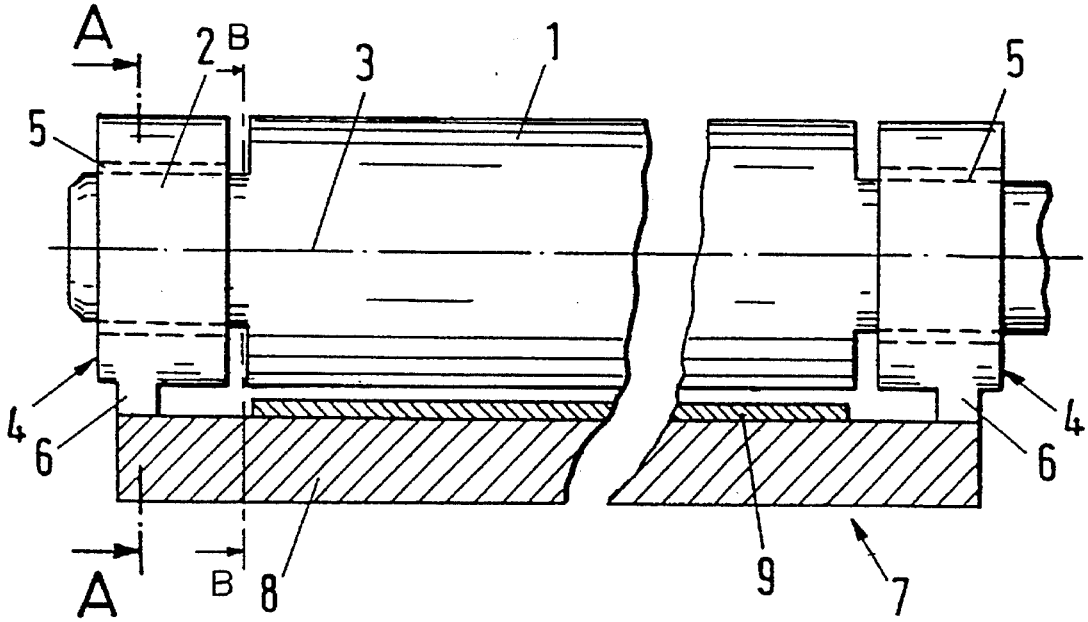
FIG. 1 is a schematic partial view of a fiber-opening roller including a cross section through a fixed carding element.

FIG. 1 shows a fiber-opening roller 1, which here preferably takes the form of a licker-in, wherein the needles, tips or saw-tooth clothings thereof are not shown. Roller 1, is retained, via its axles or shafts 2, in axle boxes or axle retainers 4. The right portion of shaft 2 is shown with a broken end section, as it is connected with a non-illustrated drive unit of any desired type. The axle or longitudinal axis of roller 1 is denominated with reference numeral 3. A rolling contact bearing 5, shown purely schematically, resides within axle box 4, with rolling contact bearing preferably taking the form of a roller or needle bearing. Axle boxes 4 include end caps 6 having attached thereto working elements 7, which, in this embodiment, take the form of a fixed carding element. Fixed carding element 7 consists of a carrier 8 and one or more combing inserts 9, with carrier 8 being attached to cap 6 by means of non-illustrated screws.

Figure 2:
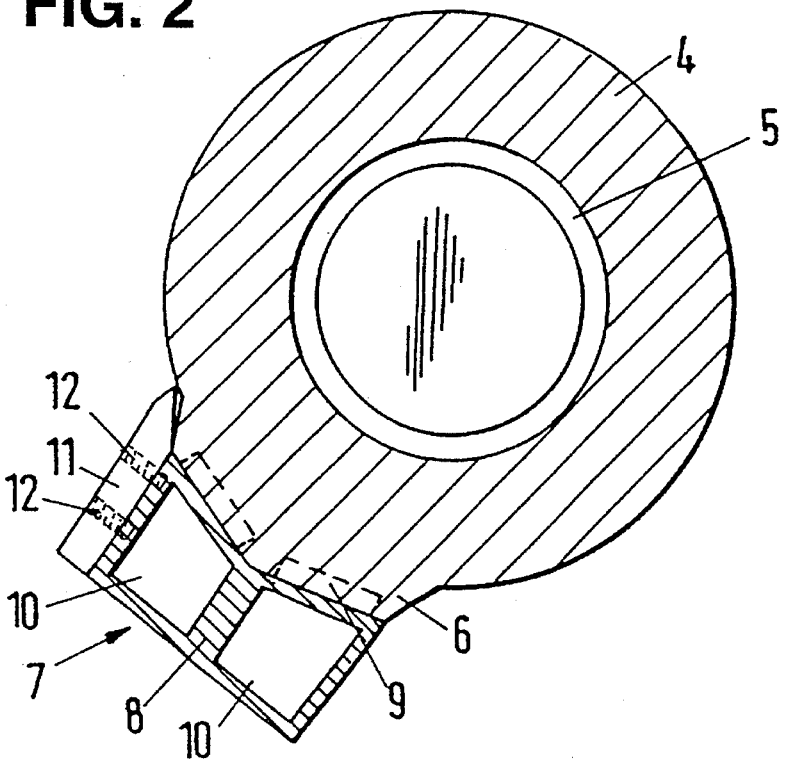
FIG. 2 is a sectional view, taken along line A—A of FIG. 1, through the axle box and the working element showing the end cap as an integral part of the axle box.
Figure 3:
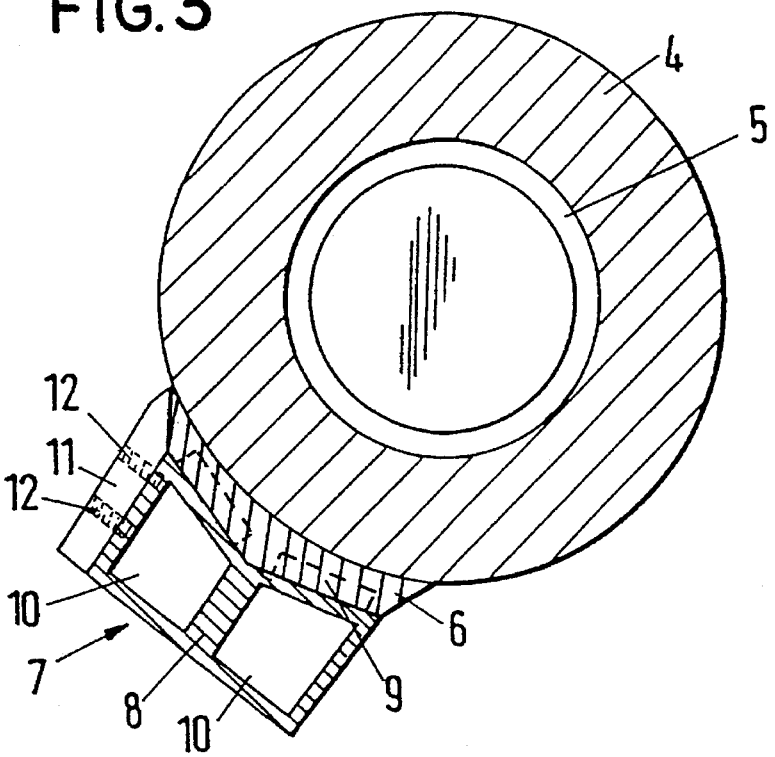
FIG. 3 is a sectional view, similar to that of FIG. 2, showing the end cap as a separate part, interposed between the axle boxes and the working element.
Figure 4:
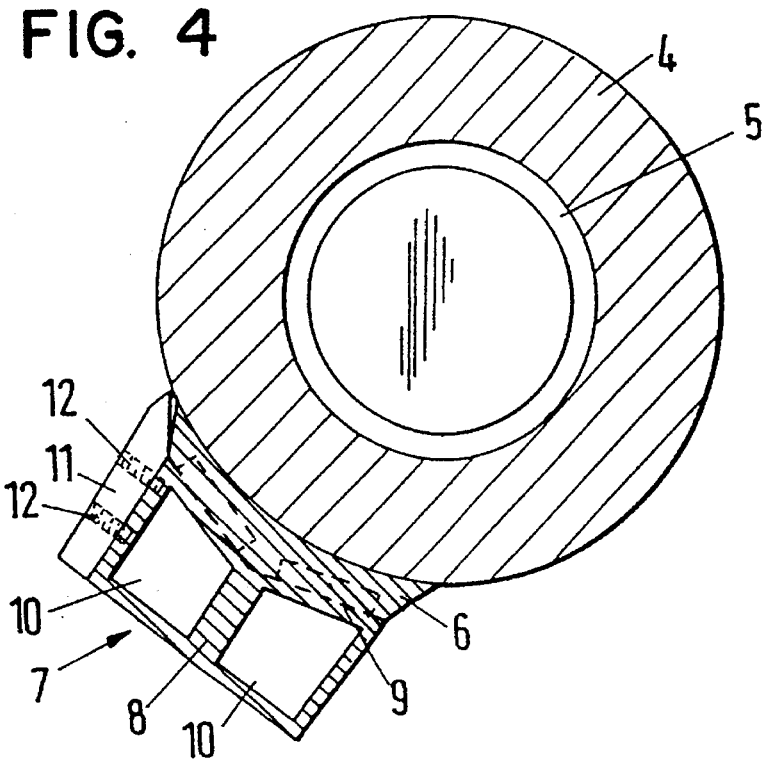
FIG. 4 is a sectional view, similar to that of FIG. 2, showing the end cap as an integral part of the working element.
Figure 5:
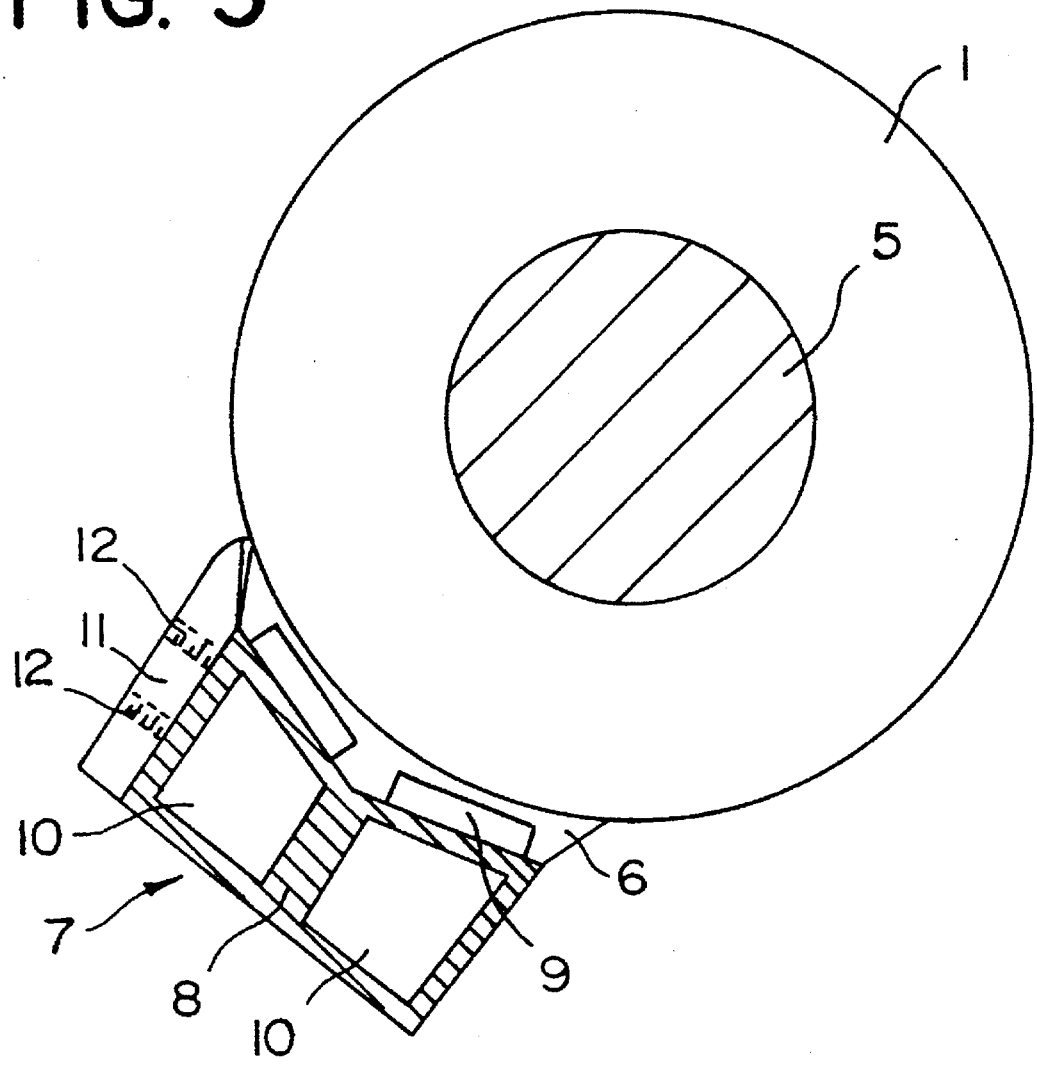
FIG. 5 is a sectional view, similar to that of FIG. 2, but taken along line B—B of FIG. 1, showing the engaging surface of the combing element situated in precisely the same plane as the engaging surface of the carrier on the axle boxes.

FIG. 2 shows the same elements as FIG. 1 and utilizes same reference numerals. As can readily be seen in the drawing, end cap 6 is arranged prismatically in the zone adjacent to carding element 7, i.e., the connecting surfaces or areas of cap 6 abutting with carrier 8 are consistent with or correspond to the surfaces or areas of a prism having n corners. Carrier 8 consists of a drawn aluminum profile having hollow chambers 10 so as to both ensure stability and to allow adequate dissipation of the heat arising during operation. On the left side of carrier 8, a separator blade 11 is fixedly attached thereto with, for example, two hexagon socket screws 12. Non-illustrated slots in separator blade 11 permit the precise positioning of the blade tip thereof with respect to the saw-tooth clothing of roller 1.

As shown in FIG. 2, carrier 8 is also, at least in the zone adjacent to end cap 6, prismatically arranged, via which the precise positioning of the carrier 8, with respect to end cap 6, occurs automatically. As visible in FIG. 2, end cap 6 is a unitary part of axle box 4, which is generally made of cast iron. However, end cap 6 may also be a separate part which is fixedly attached, such as by screws, to axle box 4. This latter embodiment, however, has the disadvantage that in this manner a less precise control of the distance of the working elements, with respect to the rollers, is achieved, since the attached connection also adds further tolerances.

The preciseness required, without the need for adjustment, can be achieved in the illustrated embodiment because the engaging surface of the comb inserts or combing elements 9 is situated in precisely the same plane or in a plane precisely parallel thereto as the engaging surface of carrier 8 on axle boxes 4. For such preciseness it is not absolutely necessary that the surfaces of the cap 6 are at least partly prismatically arranged, but recesses could also be provided in carrier 8. These recesses could, for example, be angular grooves or flutes, for which purpose congruent mating elements would be provided on cap 6. The previously-described prismatic arrangement, however, is preferred owing to the simplicity of its solution. In another embodiment, end caps 6 could also be parts or portions of carrier 8 and respective countersink areas could be provided on axle bearing 4 so as to satisfy the previously-mentioned requirement of preciseness.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. In combination, a rotatable fiber-opening roller, rotatably journalled on opposite ends thereof in longitudinally spaced axle bearing retainers and a longitudinally extending working element attached on spaced inner end surfaces thereof to said axle bearing retainers, by means of respective end caps, said end caps being interposed between end surfaces of said axle bearing retainers and the spaced end surfaces of said working element, with said end caps being fixed in a predetermined position relative to said axle bearing retainers and said working elements being fixed in a predetermined position relative to said end caps, thus assuring exact radial and pivotal location of the working element relative to the fiber-opening roller.

2. The apparatus of claim 1, wherein said end caps are rigidly connected with said axle retainers.

3. The apparatus of claim 1, wherein said end caps are rigidly connected with said working element.

4. The apparatus of claim 1, wherein said end caps are rigidly connected with both said axle retainers and said working element.

5. The apparatus of claim 2, wherein each of said end caps is provided with at least one plane surface engaging a corresponding surface of one of said working elements and said axle retainers.

6. The apparatus of claim 3, wherein each of said end caps is provided with at least one plane surface engaging a corresponding surface of one of said working elements and said axle retainers.

7. The apparatus of claim 4, wherein each of said end caps is provided with at least one plane surface engaging a corresponding surface of one of said working elements and said axle retainers.

8. The apparatus of claim 5, wherein each of said end caps is at least partially prismatically formed.

9. The apparatus of claim 6, wherein each of said end caps is at least partially prismatically formed.

10. The apparatus of claim 7, wherein each of said end caps is at least partially prismatically formed.

11. The apparatus of claim 2, wherein each of said end caps is unitary with an axle retainer.

12. The apparatus of claim 3, wherein each of said end caps is unitary with said working element.

13. The apparatus of claim 4, wherein each of said end caps is a separate unitary element interposed between said axle retainers and said working element.

14. The apparatus of claim 1, wherein said working element consists of a carrier having at least one combing insert attached thereto and facing said fiber-opening roller, said carrier having a first engaging surface coplanar with a corresponding juxtaposed second engaging surface on said axle boxes, and said combing insert having a third engaging surface with the third engaging surface being one of being situated precisely in the same plane and in a plane precisely parallel to said first and second engaging surfaces.

15. In combination, a rotatable fiber-opening roller of a preparatory machine of a spinning mill, said roller being rotatably journalled on opposite ends thereof in longitudinally spaced axle bearing retainers and a longitudinally extending working element attached on spaced inner end surfaces thereof to said axle bearing retainers, by means of respective end caps, said end caps being interposed between end surfaces of said axle bearing retainers and the spaced end surfaces of said working element, with said end caps being one of unitary with said axle retainers and said working element and being fixed in a predetermined position relative to said axle bearing retainers and said working elements being fixed in a predetermined position relative to said end caps, thus assuring exact radial and pivotal location of the working element relative to the fiber-opening roller.

16. The apparatus of claim 15, wherein each of said end caps is provided with at least one plane surface engaging a corresponding surface of one of said working elements and said axle retainers.

17. The apparatus of claim 15, wherein each of said end caps is at least partially prismatically formed.

18. The apparatus of claim 15, wherein each of said end caps is unitary with an axle retainer.

19. The apparatus of claim 15, wherein each of said end caps is unitary with said working element.

20. The apparatus of claim 15, wherein said working element consists of a carrier having at least one combing insert attached thereto and facing said fiber-opening roller, said carrier having a first engaging surface coplanar with a corresponding juxtaposed second engaging surface on said axle boxes, and said combing insert having a third engaging surface with the third engaging surface being one of being situated precisely in the same plane and in a plane precisely parallel to said first and second engaging surfaces.

* * * * *